US005222358A

United States Patent [19]

Chaput et al.

[11] Patent Number: 5,222,358

[45] Date of Patent: Jun. 29, 1993

[54] SYSTEM FOR REMOVABLY MOUNTING A PRE-VAPORIZING BOWL TO A COMBUSTION CHAMBER

[75] Inventors: Guillaume H. Chaput, Fontainebleau; Paul Martyez, Montgeron; Jean-Claude C. Taillant, Le Mee sur Seine, all of France

[73] Assignee: Societe Nationale d'Etude et de Construction de Moteurs d'Aviation S.N.E.C.M.A., France

[21] Appl. No.: 909,691

[22] Filed: Jul. 7, 1992

[30] Foreign Application Priority Data

Jul. 10, 1991 [FR] France ..... 91 08626

[51] Int. Cl.[5] ..... F23R 3/30

[52] U.S. Cl. ..... 60/39.32; 60/740

[58] Field of Search ..... 60/39.31, 39.32, 737, 60/740, 748, 756; 431/350, 351

[56] References Cited

U.S. PATENT DOCUMENTS

| | | | |
|---|---|---|---|
| 4,322,945 | 4/1982 | Peterson et al. | 60/756 |
| 4,365,470 | 12/1982 | Matthews et al. | 60/740 |
| 4,525,996 | 7/1985 | Wright et al. | 60/39.31 |
| 4,870,818 | 10/1989 | Suliga | 60/756 |
| 4,914,918 | 4/1990 | Sullivan | 60/756 |
| 4,934,145 | 6/1990 | Zeisser | 60/740 |
| 4,999,996 | 3/1991 | Duchene et al. | 60/39.32 |
| 5,117,637 | 6/1992 | Howell et al. | 60/740 |

FOREIGN PATENT DOCUMENTS

| | | | |
|---|---|---|---|
| 78630 | 5/1983 | European Pat. Off. . | |
| 242319 | 10/1987 | European Pat. Off. . | |
| 2073401 | 10/1981 | United Kingdom | 60/740 |
| 2134640 | 8/1984 | United Kingdom . | |

*Primary Examiner*—Richard A. Bertsch
*Assistant Examiner*—Timothy S. Thorpe
*Attorney, Agent, or Firm*—Bacon & Thomas

[57] ABSTRACT

A system is described for removably attaching a pre-vaporizing bowl to the wall of the combustion chamber. The system prevents relative rotation between the pre-vaporizing bowl and the combustion chamber, as well as any relative axial movement between these elements. The system enables the pre-vaporizing bowl to be readily removed from the combustion chamber without the necessity of subjecting the assembly to any machining operations. By eliminating any welded elements, the present invention eliminates the need for transporting the assembly to a machine shop in order to disassemble the elements. The system includes a mounting member fixedly attached to an upstream end of the wall of the combustion chamber around an opening defined through the combustion chamber wall to accommodate the fuel injection nozzle. A flange, which defines a groove, extends in an upstream direction from the pre-vaporizing bowl. A split annular spacer member is retained in the groove by an anti-rotation ring which has a series of tabs extending radially inwardly and a series of keys extending radially outwardly therefrom. The tabs engage corresponding notches formed in the flange extending from the pre-vaporizing bowl, while the keys engage corresponding notches formed in the mounting member, thereby preventing relative rotation between the pre-vaporizing bowl and the combustion chamber.

15 Claims, 3 Drawing Sheets

SYSTEM FOR REMOVABLY MOUNTING A PRE-VAPORIZING BOWL TO A COMBUSTION CHAMBER

BACKGROUND OF THE INVENTION

The present invention relates to a system for attaching a pre-vaporizing bowl to the wall of a combustion chamber for a turbojet engine, more particularly such a system in which the pre-vaporizing bowl may be easily removed from the combustion chamber without subjecting the gas turbine engine to a machining operation.

A pre-vaporizing bowl is operatively disposed between a fuel injector and an upstream end wall of a gas turbine engine combustion chamber. The pre-vaporizing bowl mixes intake oxidizer, such as air, with the fuel injected through the fuel injector, this mixture subsequently passing into the combustion chamber where it is ignited.

A known system for attaching the pre-vaporizing bowl to the wall of combustion chamber is shown in U.S. Pat. No. 4,999,996 to Duchene et al. In this system, the pre-vaporizing bowl is permanently attached to the combustion chamber wall so as to enable relative generally radial movement between the pre-vaporizing bowl and the combustion chamber. Such relative movement occurs during the operation of the gas turbine engine due to the temperature differences between the combustion chamber and the remaining engine structure.

In the known system, a locating flange is fixedly attached to the pre-vaporizing bowl and has an extended, radial portion which passes through a slot defined by a support collar which is welded to the wall of the combustion chamber. A stop ring welded to the support collar restrains axial movement of the locating flange while permitting relative radial movement between the combustion chamber and the pre-vaporizing bowl.

By welding the various components together, this known system attaches the pre-vaporizing bowl to the combustion chamber such that it may not be readily removed from the combustion chamber. Consequently, any defect relating to either the combustion chamber or the pre-vaporizing bowl requires the assembly to undergo complex machining operations to remove the welds so that the pre-vaporizing bowl may be separated from the combustion chamber. Such work can only be carried out in a machine shop, which necessitates the complete disassembly of the gas turbine engine and the transportation of the combustion chamber/pre-vaporizing bowl assembly to a machine shop. Quite clearly, this increases the costs and time involved in repairing the combustion chamber/pre-vaporizing bowl assembly.

SUMMARY OF THE INVENTION

The present invention describes a system for removably attaching a pre-vaporizing bowl to the wall of the combustion chamber. The system prevents relative rotation between the pre-vaporizing bowl and the combustion chamber, as well as any relative axial movement between these elements. The system enables the pre-vaporizing bowl to be readily removed from the combustion chamber without the necessity of subjecting the assembly to any machining operations. By eliminating any welded elements, the present invention eliminates the need for transporting the assembly to a machine shop in order to disassemble the elements.

The system includes a mounting member fixedly attached to an upstream end of the wall of the combustion chamber around an opening defined through the combustion chamber wall to accommodate the fuel injection nozzle. A flange, which defines a groove, extends in an upstream direction from the pre-vaporizing bowl. A split annular spacer member is retained in the groove by an anti-rotation ring which has a series of tabs extending radially inwardly and a series of keys extending radially outwardly therefrom. The tabs engage corresponding notches formed in the flange extending from the pre-vaporizing bowl, while the keys engage corresponding notches formed in the mounting member, thereby preventing relative rotation between the pre-vaporizing bowl and the combustion chamber.

The mounting member has a generally annular portion, which defines the series of notches engaged by the keys of the anti-rotation ring, this portion having a radially inwardly extending flange formed on its distal edge.

To assemble the pre-vaporizing bowl to the combustion chamber wall, it is placed in the opening in the upstream wall of the combustion chamber such that the split annular spacer member axially bears against a portion of the mounting member. In this location, the keys of the anti-rotation ring engage the notches formed in the mounting member, while the tabs extending from the anti-rotation ring engage the corresponding notches formed in the flange. The anti-rotation ring is positioned such that it axially bears against the split annular spacer member and a split, elastic ring is inserted between the anti-rotation ring and the radially inwardly extending portion of the mounting member. In order to remove the pre-vaporizing bowl from the combustion chamber, it is necessary to only remove the split, elastic ring. Removal of this element will enable the pre-vaporizing bowl to be removed from contact with the combustion chamber assembly. Thus, it can be seen that the present invention provides a system for removably attaching the pre-vaporizing bowl to the combustion chamber wall which prevents relative rotation and axial movement between the pre-vaporizing bowl and the combustion chamber, while allowing relative movement in a radial direction.

DETAILED DESCRIPTION OF THE PREFERRED EMBODIMENT

Figure 1:
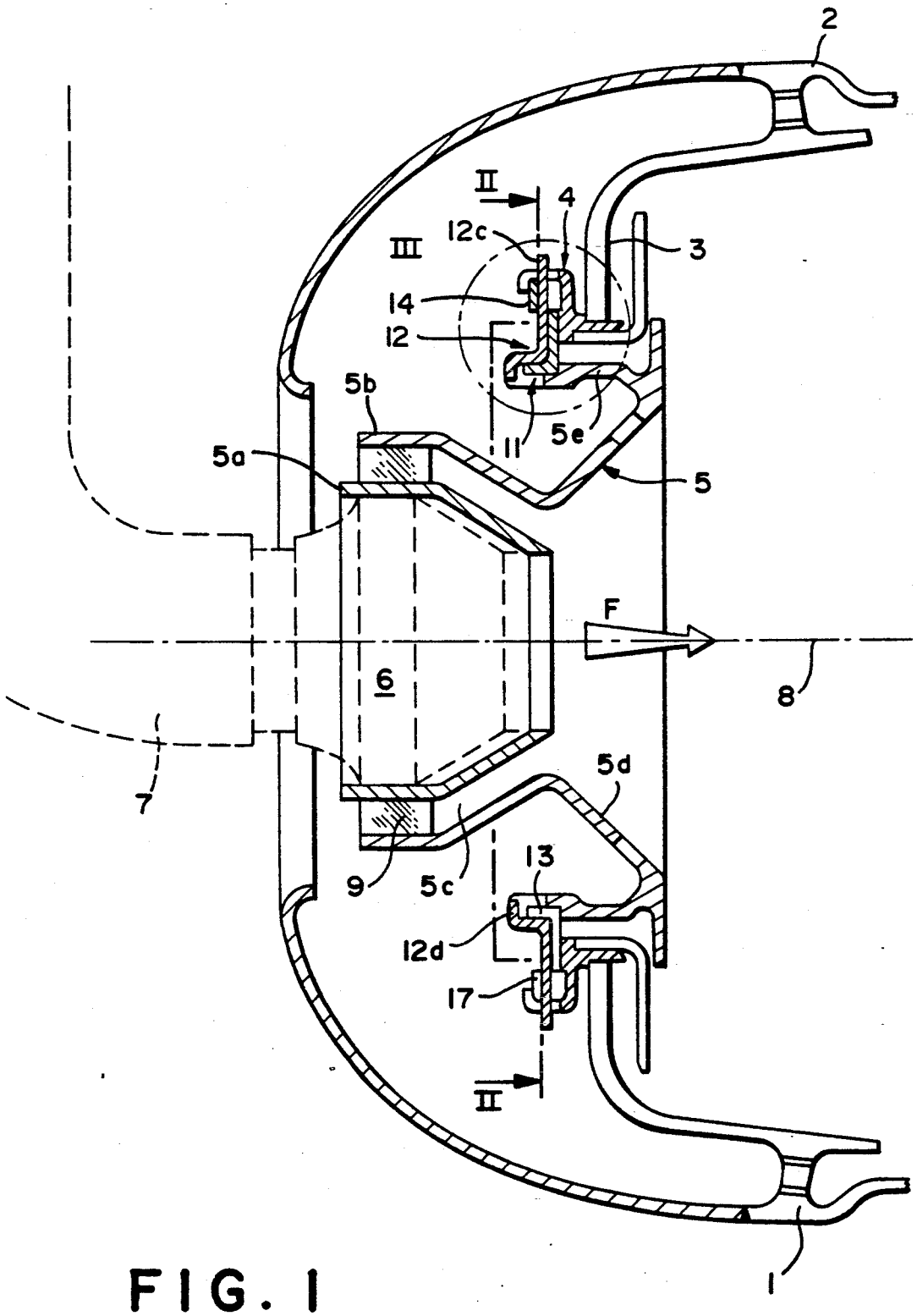
FIG. 1 is a longitudinal cross-sectional view of an upstream portion of a combustion chamber assembly illustrating the attaching system according to the present invention.

FIG. 1 illustrates a cross sectional view of an upstream end of an annular combustion chamber of a gas turbine engine defined by inner and outer walls 1 and 2, respectively. The upstream wall 3 of the combustion chamber defines a series of generally circular openings, each having a longitudinal axis 8. In known fashion, these series of openings are circumferentially distributed around the upstream end of the combustion chamber and accommodate fuel injection nozzles and pre-vaporizing bowls. A typical fuel injector 6 supplied with fuel through conduit 7 is illustrated in FIG. 1.

The pre-vaporizing bowl 5 comprises an inner portion 5*a* which is concentric with, and located within an outer portion 5*b*. Both of these portions extend generally coaxially with the longitudinal axis 8. The inner and outer portions 5*a* and 5*b* are interconnected by a series of generally radially extending fins 9 which impart a swirling movement to the incoming oxidizer (usually air) which passes between the portions 5*a* and 5*b*.

Downstream of the swirl fins 9, inner and outer portions 5*a* and 5*b* form generally annular, frusto-conical portions which define an oxidizer passage 5*c* between them. Further downstream, the outer portion of the pre-vaporizing bowl comprises an expanding, frusto-conical portion 5*d* which expands outwardly in a downstream direction. In operation, oxidizer passing through the passage 5*c* is mixed with fuel emanating from the fuel injection nozzle 6 and the mixture passes in the direction of arrow F into the combustion chamber.

Figure 5:
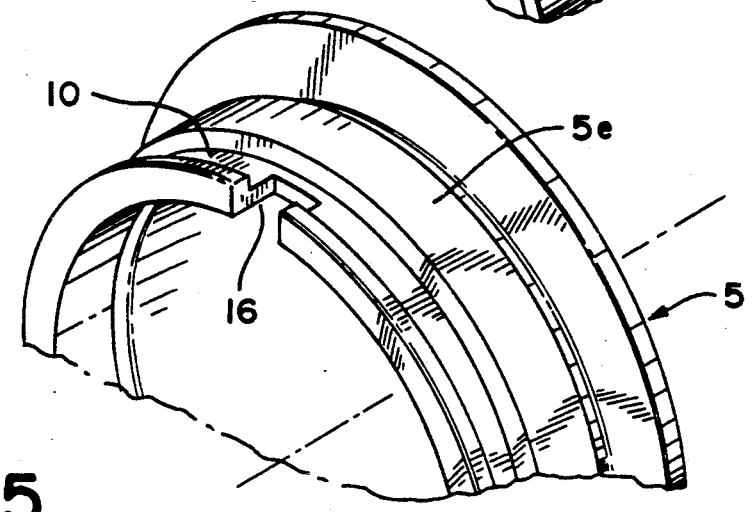
FIG. 5 is a partial, perspective view of the pre-vaporizing bowl used with the attachment system according to the present invention.

Flange 5*e* extends from the downstream end of the pre-vaporizing bowl 5 in an upstream direction and has a generally annular configuration. As best seen in FIGS. 1 and 5, the flange 5*e* defines a groove 10 in a radially outer surface. Flange 5*e* also defines a plurality of notches 16 which extend in a downstream direction from its upstream edge portion. Flange 5*e* may be integrally formed with the pre-vaporizing bowl 5, or may be otherwise fixedly attached thereto.

Figure 3:
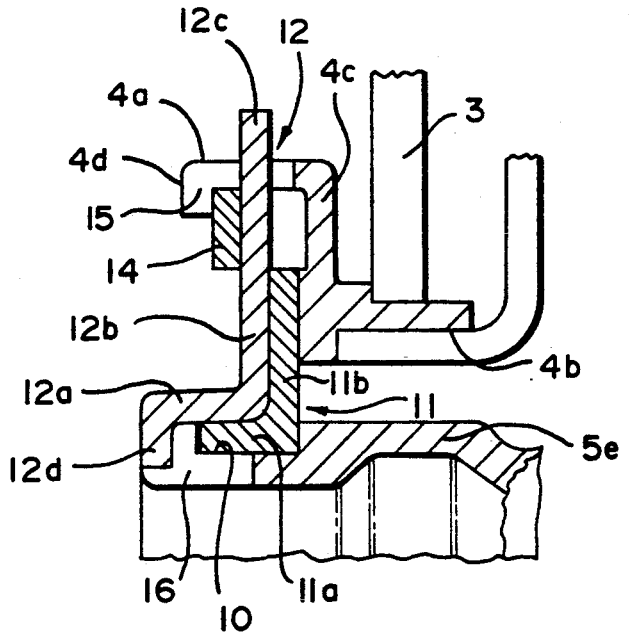
FIG. 3 is an enlarged, cross sectional view of the area III in FIG. 1.

The groove 10 is designed to accommodate a generally cylindrical base portion 11*a* of split annular spacer member 11 split at 13, as illustrated in FIGS. 1 and 3. The annular spacer member 11 has a generally annular configuration with a radially extending split 13 to enable the spacer member to be slightly contracted or expanded. The spacer member 11 has a generally "L" shaped cross sectional configuration with portion 11*b* extending generally radially from the generally cylindrical base portion 11*a*.

The annular spacer member 11 is retained in the groove 10 by an anti-rotation ring 12. Anti-rotation ring 12 also has a annular configuration with a generally "L"-shaped cross section. Generally cylindrical axial portion 12*a* radially bears against portion 11*a* of the split annular spacer member 11, as illustrated in FIG. 3, to retain the annular spacer member 11 in groove 10. The axial dimension of portion 11*a* is only slightly smaller than the axial width of groove 10 such that substantially no axial movement between the flange 5*e* and the spacer member 11 may take place. The inner diameter of cylindrical portion 12*a* is only slightly greater than that of the flange 5*e* such that sliding the anti-rotation ring axially over the end of the flange 5*e* securely holds the annular spacer member 11 within groove 10 by slightly compressing split 13.

Anti-rotation ring 12 also has radial portion 12*b* extending radially from the cylindrical axial portion 12*a* such that it axially bears against the radial portion 11*b* of the annular spacer member 11. In order to place the annular spacer member 11 in groove 10, it may be slightly radially expanded, enabled by its radial split, over the distal end of flange 5*e* until it is aligned with groove 10.

Relative rotation between the anti-rotation ring 12 and the flange 5*e* of the pre-vaporizing bowl 5 is prevented by the engagement of tabs 12*b*, which extend radially inwardly from an end of the axial portion 12*a* and one of the notches 16 defined by the upstream edge of the flange 5*e*.

Figure 4:
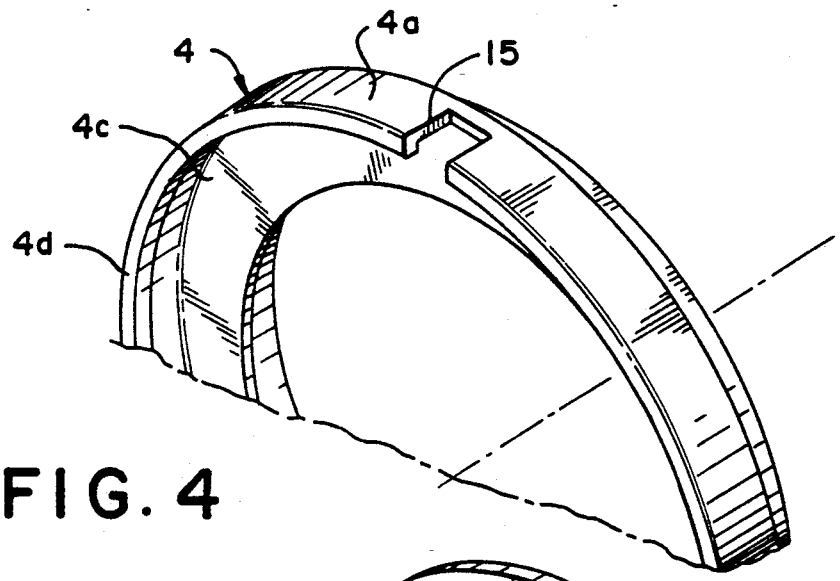
FIG. 4 is a partial, perspective view of the mounting member according to the present invention.

A mounting member 4 comprises a first axially extending cylindrical portion 4*b* and a second axially extending cylindrical portion 4*a* which are interconnected by generally radially extending portion 4*c*. Axially extending cylindrical portion 4*b* is dimensioned so as to fit within the opening defined by the upstream wall 3 and may be fixedly attached thereto, such as by welding or the like. As best illustrated in FIG. 4, the axially extending cylindrical portion 4*a* defines a series of notches 15 which extend inwardly from its upstream edge portion. This upstream edge portion also has a radially inwardly extending rim 4*d* whose inner diameter is slightly larger than the outer diameter of anti-rotation ring 12 and annular spacer member 11. As can be seen from FIG. 3, the inner diameter of the axially extending cylindrical portion 4*a* is greater than the diameter of axially extending cylindrical portion 4*b*.

To assemble the system according to the present invention, the annular spacer member 11 is placed in groove 10 and the anti-rotation ring 12 is axially moved over the upstream edge portion of the flange 5*e* to hold the annular spacer member 11 in the groove 10. Engagement of tabs 12*d* with notches 16 prevent any relative rotation between the anti-rotation member 12 and the pre-vaporizing bowl 5.

This assembly is placed into the opening defined by the upstream wall 3 of the combustion chamber such that the radial portion 11*b* of the annular spacer member 11 axially contacts a surface of the radial portion 4*c* of the mounting member 4. When in this position, keys 12*c* which extend radially outwardly from portion 12*b* pass through notches 15 defined by the cylindrical portion 4*a* of the mounting member 4. The engagement of these elements prevents any relative rotation between the antirotation member 12 and the mounting member 4.

A resilient, split ring fastener 14 is then compressed and inserted into contact with an upstream axial surface of the radially extending portion 12*b* of the anti-rotation ring 12 and the radially inwardly extending rim 4*d* of the mounting member 4. When the resilient fastener is released, it expands radially outwardly so as to be fixedly secured in this position. As can be seen in FIG. 3, relative axial movement between the pre-vaporizing bowl 5 and the mounting member 4 is prevented by the axial contact between the annular spacer member 11, as well as the resilient fastener member 14 with oppositely facing radial surfaces of the mounting member 4. Thus, both relative rotation and relative axial movement between the pre-vaporizer bowl 5 and the combustion chamber is prevented according to the present attachment system.

Figure 2:
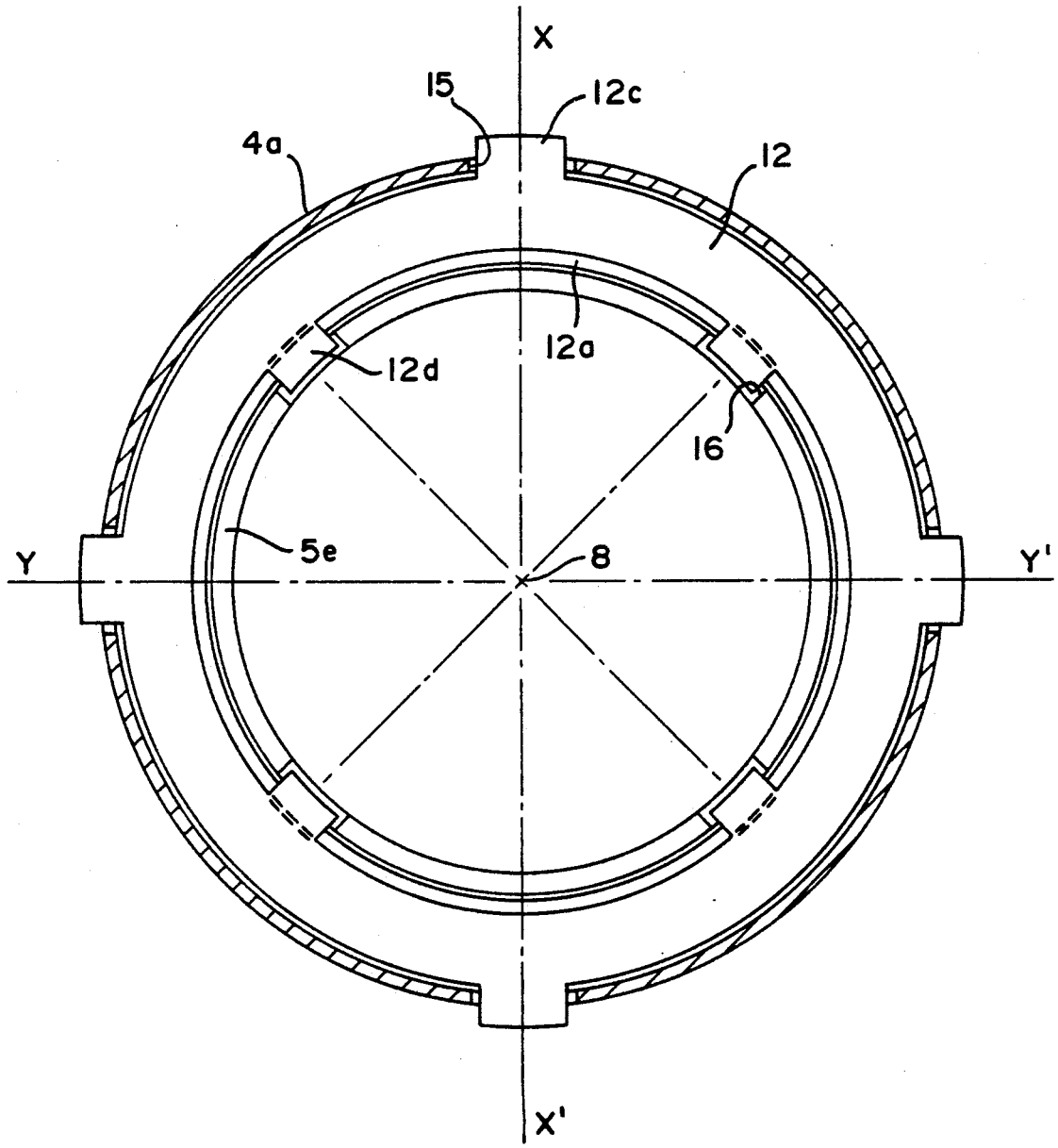
FIG. 2 is a cross-sectional view taken along line II—II in FIG. 1.

As illustrated in FIG. 2, the notches 16 are circumferentially spaced around the periphery of the flange 5*e*, as are notches 15 circumferentially spaced around the axially extending portion 4*a* of the mounting member 4. Notches 15 and 16, along with their respective engagement tabs 12*d* and keys 12*c* may also be circumferentially offset with respect to each other. The keys 12*c*, along with the notches 15 may be located along generally orthogonal axes XX' and YY'. The diametrical lines extending between opposite notches 16 may be circumferentially displaced approximately 45° from the axes XX' and YY'. Alternatively, these lines may be aligned with these axes.

In order to allow four small displacements of the pre-vaporizing bowl 5 along the XX' axis, caused by differential thermal expansion of the elements, the keys 12*c* may have a smaller dimension, measured in a circumferential direction, than do notches 15. Also, the outer diameter of the anti-rotation ring 12 is somewhat smaller than the inner diameter of axially extending cylindrical portion 4*a* of the mounting member 4.

The foregoing description is provided for illustrative purposes only and should not be construed as in any way limiting this invention, the scope of which is defined solely by the appended claims.

We claim:

1. A system for removably attaching a pre-vaporizing bowl to a combustion chamber wall of a gas-turbine engine, the combustion chamber having a longitudinal axis, comprising:

a) a mounting member fixedly attached to the wall of the combustion chamber;

b) a flange extending from the pre-vaporizing bowl, the flange defining a groove therein;

c) a split annular spacer member having a first portion located in the groove and a second portion bearing against the mounting member in an axial direction;

d) an anti-rotation ring axially bearing against the split annular spacer member;

e) first anti-rotation means operatively interposed between the anti-rotation ring and the flange so as to substantially prevent relative rotation between the anti-rotation ring and the pre-vaporizing bowl about the longitudinal axis;

f) second anti-rotation means operatively interposed between the anti-rotation ring and the mounting member so as to substantially prevent relative rotation between the anti-rotation ring and the mounting member about the longitudinal axis; and, g) removable stop means operatively interposed between the mounting member and the anti-rotation ring to substantially prevent axial movement between the anti-rotation ring and the mounting member.

2. The system according to claim 1 wherein the split annular spacer member has a generally "L" shaped cross-sectional configuration comprising a generally cylindrical base portion disposed in the groove and a generally radial portion extending from the base portion.

3. The system according to claim 2 wherein the anti-rotation ring has a generally "L"-shaped cross-sectional configuration comprising a generally cylindrical axial portion and a second generally radial portion extending from the axial portion such that the axial portion is in radial contact with the base portion of the split annular spacer member and the second radial portion is in axial contact with the radial portion of the split annular spacer member.

4. The system of claim 1 wherein the first anti-rotation means comprises:

a) at least one first notch defined by the flange; and, b) at least one tab extending from the anti-rotation ring into the at least one first notch.

5. The system of claim 1 wherein the second anti-rotation means comprises:

a) at least one second notch defined by the mounting member; and b) at least one key extending from the anti-rotation ring into the at least one second notch.

6. The system of claim 1, wherein the first anti-rotation means comprises:

a) a plurality of first notches defined by the flange, the plurality of first notches being substantially equidistantly spaced apart around the flange; and b) a plurality of tabs extending from the anti-rotation ring and located such that each tab enters a corresponding first notch defined by the flange.

7. The system of claim 6 wherein the second anti-rotation means comprises:

a) a plurality of second notches defined by the mounting member, the plurality of second notches being substantially equidistantly spaced apart around the mounting member; and b) a plurality of keys extending from the anti-rotation ring and located such that each key enters a corresponding second notch defined by the mounting member.

8. The system of claim 7 wherein the flange, the anti-rotation ring and the mounting member each have a substantially annular configuration.

9. The system of claim 8 wherein the plurality of first notches comprises an even number of first notches such that the first notches are located generally diametrically opposite each other.

10. The system of claim 9 wherein the plurality of second notches comprises an even number of second notches such that the second notches are located generally diametrically opposite each other.

11. The system of claim 10 wherein the number of tabs extending from the anti-rotation ring is equal to the number of keys extending therefrom.

12. The system of claim 11 wherein the tabs extending from the anti-rotation ring are circumferentially displaced from the keys extending therefrom.

13. The system of claim 8 wherein a circumferential width of each second notch is greater than a corresponding width of each key.

14. The system of claim 1 wherein the mounting member comprises:

a) a first axially extending cylindrical portion attached to the combustion chamber wall;

b) a second axially extending cylindrical portion having an inner diameter greater than the diameter of the first axially extending cylindrical portion; and c) a generally radially extending portion interconnecting the first and second axially extending cylindrical portions.

15. The system of claim 14 wherein the anti-rotation ring comprises an annular radial portion having an outer diameter less than that of the inner diameter of the second axially extending portion of the mounting member.

* * * * *